US009042591B2

(12) United States Patent
Millikan

(10) Patent No.: US 9,042,591 B2
(45) **Date of Patent: *May 26, 2015**

(54) REDUCING THE TANGLING OF CABLES

(71) Applicant: Thomas Nathan Millikan, San Diego, CA (US)

(72) Inventor: Thomas Nathan Millikan, San Diego, CA (US)

(73) Assignee: Thomas Nathan Millikan, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/027,227

(22) Filed: Sep. 15, 2013

(65) Prior Publication Data

US 2014/0247950 A1 Sep. 4, 2014

Related U.S. Application Data

(63) Continuation of application No. 13/783,373, filed on Mar. 3, 2013, now Pat. No. 8,913,775.

(60) Provisional application No. 61/622,451, filed on Apr. 10, 2012, provisional application No. 61/646,249, filed on May 11, 2012.

(51) Int. Cl.
*H04R 25/00* (2006.01)
*H04R 1/10* (2006.01)

(52) U.S. Cl.
CPC ..... *H04R 1/1033* (2013.01)

(58) Field of Classification Search
USPC ..... 381/309, 370, 373, 376, 380, 384; 181/129, 130, 135; 379/430, 438; 455/351, 575.1, 90.3; 242/385
See application file for complete search history.

(56) References Cited

U.S. PATENT DOCUMENTS

| | | | | |
|---|---|---|---|---|
| 5,339,461 | A * | 8/1994 | Luplow | 455/351 |
| 6,847,724 | B1 * | 1/2005 | Weng et al. | 381/370 |
| 7,387,209 | B2 | 6/2008 | Ko et al. | |
| 8,121,304 | B2 | 2/2012 | Bales et al. | |
| 8,290,193 | B2 | 10/2012 | Pang et al. | |
| 2007/0023559 | A1 | 2/2007 | Scapillato et al. | |
| 2008/0101633 | A1 | 5/2008 | Ledbetter et al. | |
| 2011/0056721 | A1 | 3/2011 | Goodman | |
| 2011/0170733 | A1 | 7/2011 | Aase et al. | |
| 2011/0243346 | A1 | 10/2011 | Aase et al. | |
| 2011/0317865 | A1 * | 12/2011 | Stevinson | 381/384 |
| 2012/0012689 | A1 | 1/2012 | Alden | |
| 2012/0121120 | A1 | 5/2012 | Gorzelany | |
| 2012/0170790 | A1 | 7/2012 | Pang et al. | |
| 2012/0230533 | A1 | 9/2012 | Dallas | |

FOREIGN PATENT DOCUMENTS

| | | |
|---|---|---|
| CN | 201238373 Y | 5/2009 |
| CN | 201499282 U | 6/2012 |

(Continued)

OTHER PUBLICATIONS

Amy-Mae Elliott, 5 iPhone Cases to Keep Your Earbuds Tangle-Free, http://mashable.com/2012/10/03/iphone-cases-cable-management/, Oct. 3, 2012.

(Continued)

*Primary Examiner* — Huyen D Le

(57) ABSTRACT

Corded devices, such as headphones and power suppliers, can be stored in a case that reduces the tendency of their cords to tangle without the need for wrapping or winding.

18 Claims, 6 Drawing Sheets

(56) References Cited

FOREIGN PATENT DOCUMENTS

| | | | |
|---|---|---|---|
| JP | 60196097 | A | 10/1985 |
| JP | 4014399 | A | 1/1992 |
| JP | 8102987 | A | 4/1996 |
| JP | 8140174 | A | 5/1996 |
| JP | 9307981 | A | 11/1997 |
| JP | 2004064537 | A | 2/2004 |
| JP | 2005064996 | A | 3/2005 |
| JP | 3655573 | B2 | 6/2005 |
| KR | 20100012896 | U | 12/2010 |

OTHER PUBLICATIONS

Amy-Mae Elliott, 10 Fun Headphone Cable Management Solutions, http://mashable.com/2011/02/26/headphone-cable-management/, Feb. 26, 2011.

Tim Stevens, Sinch takes aim at headphone tangles, we go hands-on, http://www.engadget.com/2011/09/12/sinch-takes-aim-at-headphone-tangles-we-go-hands-on/, Sep. 12, 2011.

Nicole kruzel, 15 Tangle-free Headphone Finds, https://lonelybrand.com/blog/15-tangle-free-headphone-finds/, Jul. 18, 2012.

* cited by examiner

REDUCING THE TANGLING OF CABLES

PRIORITY

This application is a Continuation of U.S. patent application Ser. No. 13/783,373, filed on Mar. 3, 2013, which claims priority to U.S. Provisional Applications 61/622,451 filed on Apr. 10, 2012 and 61/646,249 filed on May 11, 2012 both entitled "Reducing the Tangling of Cables," which are incorporated herein in their entirety.

TECHNICAL FIELD

The present disclosure relates to cases that reduce the all-to-common problem of tangled headphones and tangled cables.

BACKGROUND

Headphones (e.g. earbuds, on-the-ear, or over-the-ear speakerphones) include cables that connect the headphones to a music device. When the headphones are stored, the cables can become a tangled mess. Likewise, other cables or cabled devices, such as power supplies for consumer electronics, can become a tangled mess when they are stored. Users may need to spend minutes untangling them. Moreover, repeated tangling imposes stress on such cables that, over time, may damage their performance or cause them to fray and break.

Conventional attempts to solve this problem have numerous drawbacks and limitations. Some attempts require a user to wrap the cable around a device, which can be time consuming and, ironically, can with time and repetition cause the very same kind of destructive stress as tangling. Other attempts to modify the headphone or power supply, including making the cables more stiff or ribbon-like, can increase costs and make the headphones uncomfortable and/or bulky. Modifications to any particular model of headphone or power supply will not solve this problem in the aggregate.

SUMMARY

The present inventor recognized the need to simply and quickly store headphones, power supplies, and other cabled devices with a reduced risk of tangling. Further, the inventor recognized the need to simplify use of a tangle-reducing case by integrating instructions on the use of the case.

In general, in one aspect, the techniques can be implemented to include a case with an opening; a speaker-portion securing device attached to the inside of the case operable to secure the speaker-portion of a pair of headphones; a headphone jack attached to the inside of the case and operable to secure a headphone plug inserted into the headphone jack. Further, the techniques can be implemented such that the speaker-portion securing device is a magnet. Further, the techniques can be implemented such that the speaker-portion securing device is a separator that divides the inside of the case into two compartments wherein the two compartments have openings adjacent to one another and aligned with the opening of the case. Further, the techniques can be implemented such that the speaker-portion securing device is a pouch large enough to store speaker-portions of earbuds. Further, the techniques can be implemented such that a portion of the case is made out of one of neoprene, textiles, plastics, or rubber. Further, the techniques can be implemented to include a means for closing the opening of the case attached to the opening. Further, the techniques can be implemented to include an instruction printed on or attached to the inside of the case. Further, the techniques can be implemented to include a bag, wherein the case and bag are integrated. Further, the techniques can be implemented to include clothing, wherein the case and clothing are integrated.

In general, in one aspect, the techniques can be implemented to include a case large enough to hold on-the-ear or over-the-ear headphones with an opening; and a headphone jack attached to the inside of the case and operable to secure a headphone plug inserted into the headphone jack. Further, the techniques can be implemented to include a flap that separates the case into two compartments. Further, the techniques can be implemented such that a portion of the case is made out of one of neoprene, textiles, plastics, or rubber. Further, the techniques can be implemented to include a means for closing the opening of the case attached to the opening. Further, the techniques can be implemented to include an instruction printed on or attached to the inside of the case. Further, the techniques can be implemented to include a bag, wherein the case and bag are integrated. Further, the techniques can be implemented to include clothing, wherein the case and clothing are integrated.

In general, in one aspect, the techniques can be implemented to include a case with an opening; a pouch inside of the case operable to secure the speaker-portion of a pair of headphones; a headphone jack attached to the inside of the first compartment and operable to secure a headphone plug inserted into the headphone jack; and elastic attached to the opening of the pouch. Further, the techniques can be implemented such that a portion of the case is made out of one of neoprene, textiles, plastics, or rubber. Further, the techniques can be implemented to include a means for closing the opening of the case attached to the opening. Further, the techniques can be implemented to include a bag, wherein the case and bag are integrated.

Various implementations of the subject matter described herein may provide one or more of the following advantages. In one or more implementations, the techniques and systems described herein can substantially reduce or eliminate tangling by cabled devices. Additionally, in one or more implementations, the techniques and systems can simplify the storage of cabled devices by allowing for storage without winding or wrapping.

These general and specific techniques can be implemented using an apparatus, a method, a system, or any combination of apparatuses, methods, and systems. The details of one or more implementations are set forth in the accompanying drawings and the description below. Further features, aspects, and advantages will become apparent from the description, the drawings, and the claims.

BRIEF DESCRIPTION OF THE DRAWINGS

Like reference symbols indicate like elements throughout the specification and drawings.

DETAILED DESCRIPTION

Figure 1:
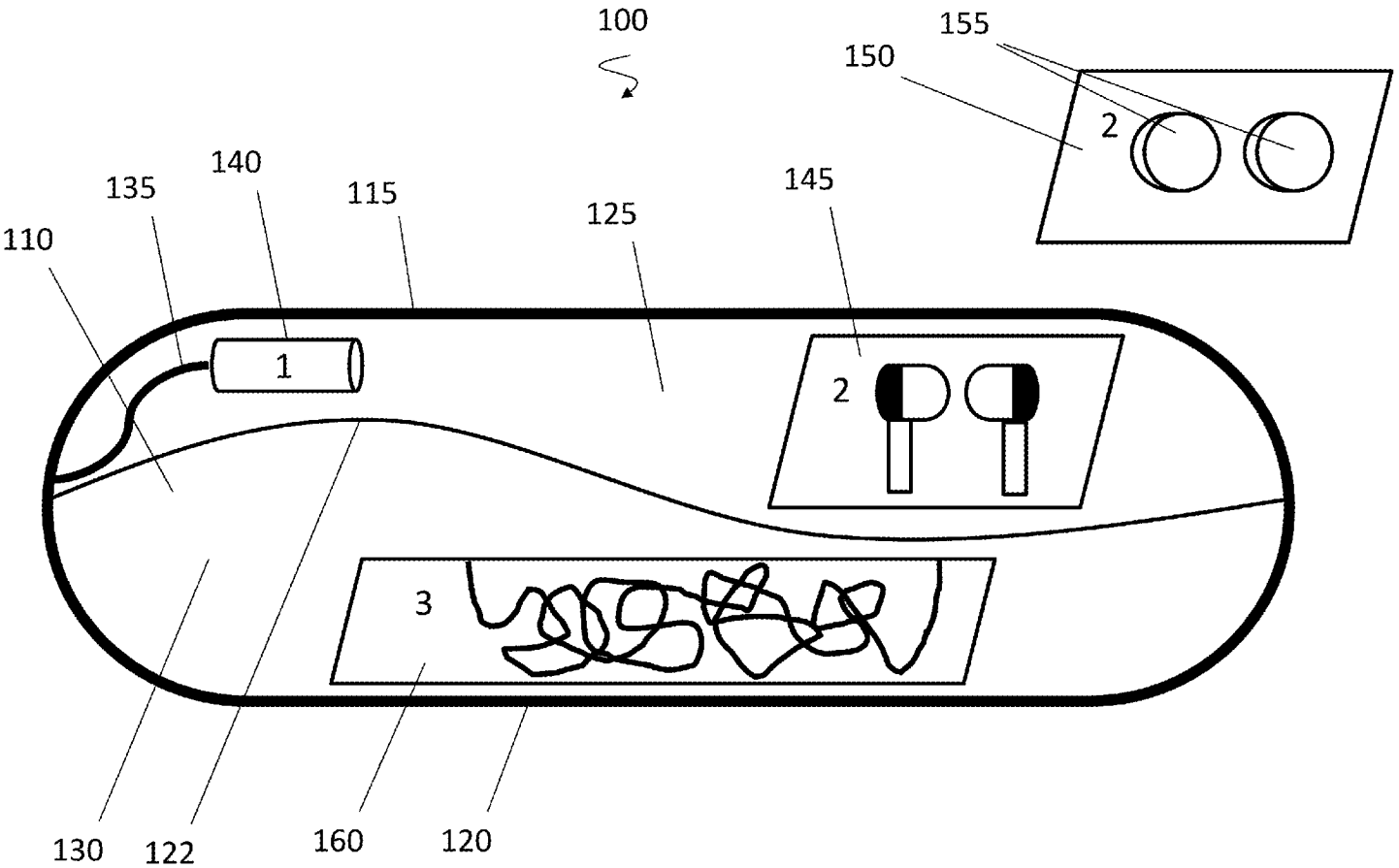
FIG. 1 shows an exemplary headphone storage case.

FIG. 1 shows an exemplary headphone storage case. Case 100 can include a pouch 110 comprised of the space between top piece 115 and bottom piece 120. Top piece 115 and bottom piece 120 can be fused along a portion of their length, while the remainder can include a zipper, Velcro, or other closure device to enable a user to close the mouth of pouch 110. Case 100 can be made of any material used to store electronics, such as neoprene, textiles, plastics, rubber, etc. Separator 122 can divide pouch 110 into a top compartment 125 and a bottom compartment 130. Inside of top compartment 125, a user can store a headphone plug and the speaker portions of the headphones. In bottom compartment 130, a user can store the cable portion of the headphones. Top compartment 125 can include a cable 135 that attaches a headphone jack 140 to pouch 110. Headphone jack 140 can, alternatively, be directly connected to pouch 110. A user can insert the headphone plug into the headphone jack 140 to secure it and limit its movements.

Headphone jack 140 can include writing, such as "1" or "Step 1" to indicate to a user they should first plug the headphone plug into headphone jack 140. Top compartment 125 can include picture 145, which shows a picture of a pair of earbud-style headphones. Picture 145 can include writing, such as "2" or "Step 2" to indicate to a user that the second step is to place the speaker-portion of the headphones adjacent to picture 145. Alternatively, picture 145 can be replaced with speaker-portion securing device 150. Speaker-portion securing device 150 can be attached to case 110. Speaker-portion securing device 150 can include holes 155, where a user can insert the speaker-portion of the headphones to secure them inside the case. Speaker-portion securing device 150 can be a taught Velcro strap. Bottom compartment 130 can include picture 160, which shows a picture of a cable. Picture 160 can include writing, such as "3" or "Step 3" to indicate to a user that the third step is to place the cable-portion of the headphones inside bottom compartment 130. The writing on headphone jack 140, picture 145, and picture 160 can be changed to reorder the suggested steps. Pictures 145 and 160 can be attached to case 100 or left unattached in approximately the same place as initial instructions.

Figure 2:
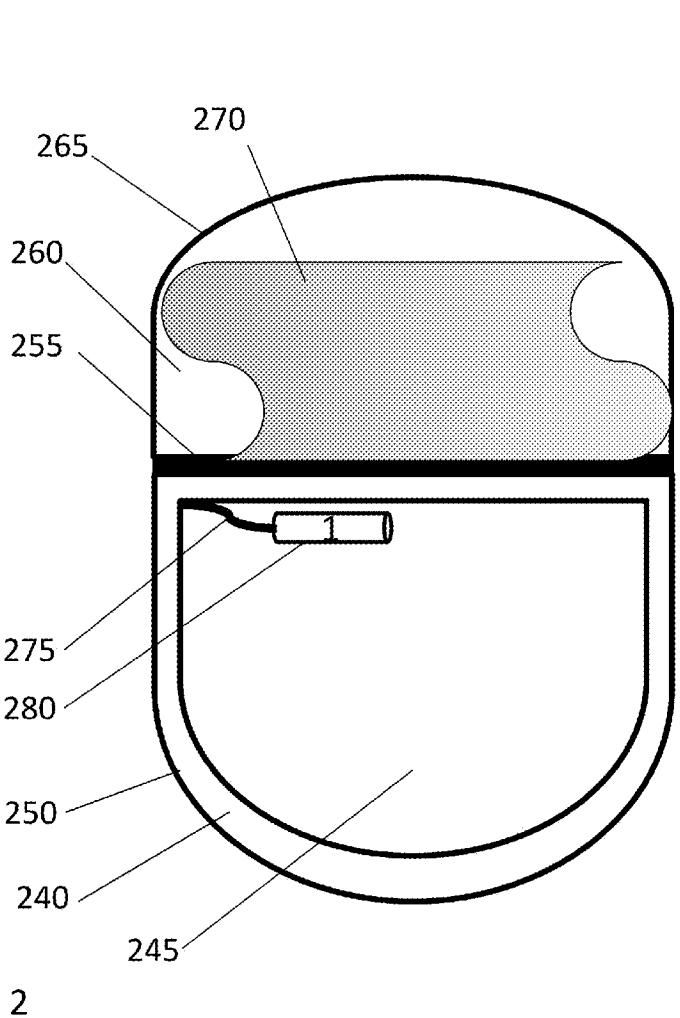
FIG. 2 shows another exemplary headphone and storage case.
Figure 2:
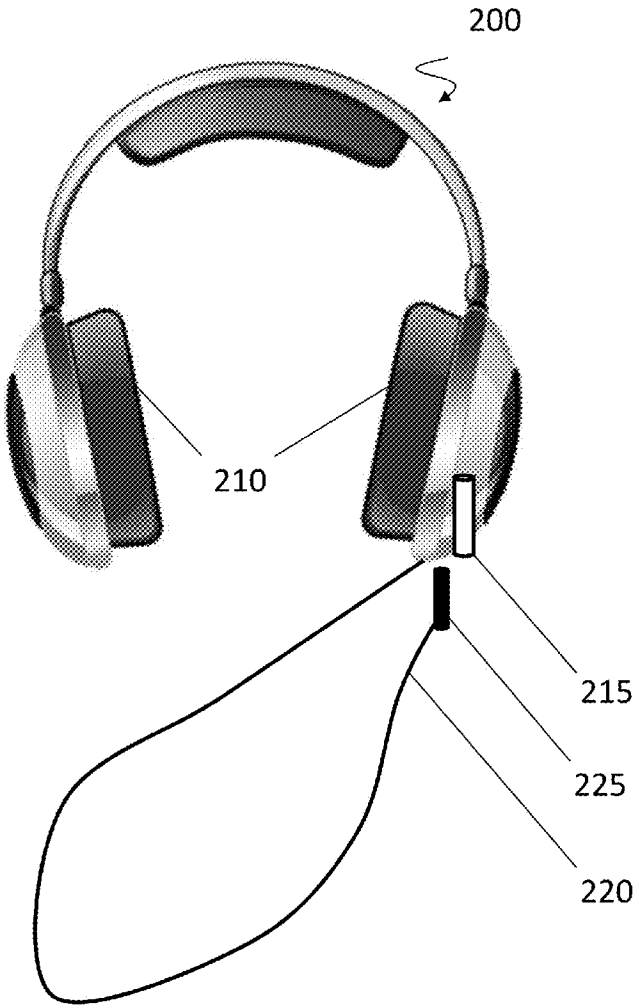

FIG. 2 shows another exemplary headphone and storage case. Over-the-ear headphones 200 can include speaker portions 210. Headphones 200 can also include a cable 220 that terminates with headphone plug 225. Headphones 200 can include a built-in receptacle 215. A user can insert headphone plug 225 into receptacle 215 to reduce tangling.

Case 240 can include a bottom piece 250 and a top piece 265. Bottom piece 250 can include a bottom compartment 245. Bottom piece 250 and top piece 265 can include a zipper, Velcro, or other means to close case 240. Top piece 265 can include a top compartment 260.

Bottom compartment 245 can be large enough to hold headphones 200. Bottom compartment 245 can include a cable 275 that attaches a headphone jack 280 to case 240. Headphone jack 280 can, alternatively, be directly connected to case 240. A user can insert headphone plug 225 into the headphone jack 280 to secure it and limit its movements. Headphone case 240 can include a flap 270, which can be used to separate compartments 245 and 260.

After a user inserts headphone plug 225 into headphone jack 280 and puts headphones 200 into bottom compartment 245, a user can put flap 270 on top of the headphones 200, put the headphone cable 220 on top of flap 270, and close case 240. Case 240 can also include pictures or words indicating where to put the headphones, headphone plug, and/or cabling, as well as the recommended order.

Figure 3:
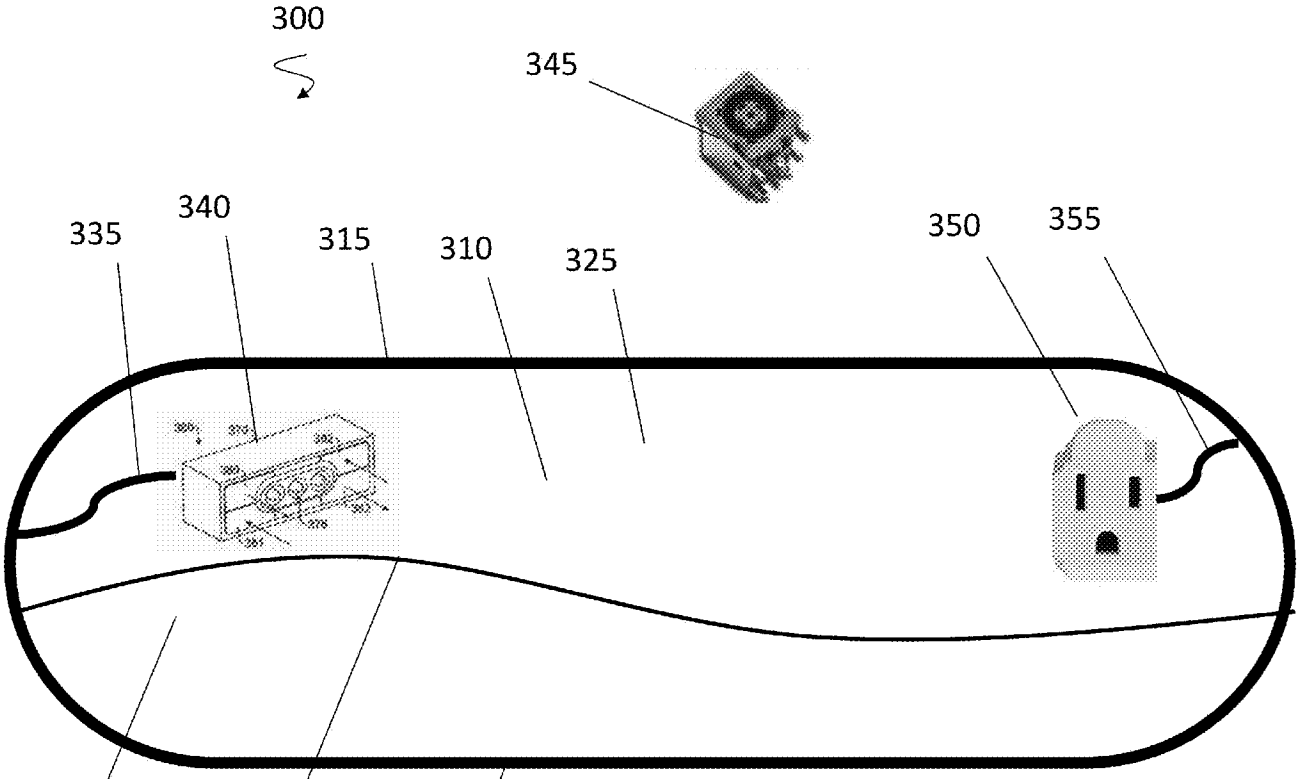
FIG. 3 shows an exemplary corded device storage case.

FIG. 3 shows an exemplary corded device storage case. Case 300 can include a pouch 310 comprised of the space between top piece 315 and bottom piece 320. Top piece 315 and bottom piece 320 can be fused along a portion of their length, while the remainder can include a zipper, Velcro, or other closure device to enable a user to close the mouth of pouch 310. Case 300 can be made of any material used to store electronics, such as neoprene, textiles, plastics, rubber, etc. Separator 322 can divide pouch 310 into a top compartment 325 and a bottom compartment 330. Inside of top compartment 325, a user can store the plug ends of a corded device. In bottom compartment 330, a user can store the cable portion of a corded device. Top compartment 325 can include a cable 335 that attaches a MagSafe receptacle 340 to pouch 310. MagSafe receptacle 340 can, alternatively, be directly connected to pouch 310. A user can insert the MagSafe end of a power cord into MagSafe receptacle 340 to secure it and limit its movements. Electrical outlet 350 can be attached to pouch 310 by cable 355. Electrical outlet 350 can, alternatively, be directly connected to pouch 310. Case 300 can also include pictures or writing indicating where to put the MagSafe plug, electrical outlet plug, and/or cabling, as well as the recommended order.

In an alternative example, MagSafe receptacle 340 and/or electrical outlet 350 can be a USB receptacle, an Apple 30-pin receptacle, a different power outlet, or other receptacle used on the ends of cords of portable electronics. By using the type of receptacle required for the specific cable or device, or something similar, the user intuitively knows to insert the end of the cable into the receptacle, how to insert the end into the receptacle, and that the receptacle is more likely to secure the end of the cable.

Figure 4:
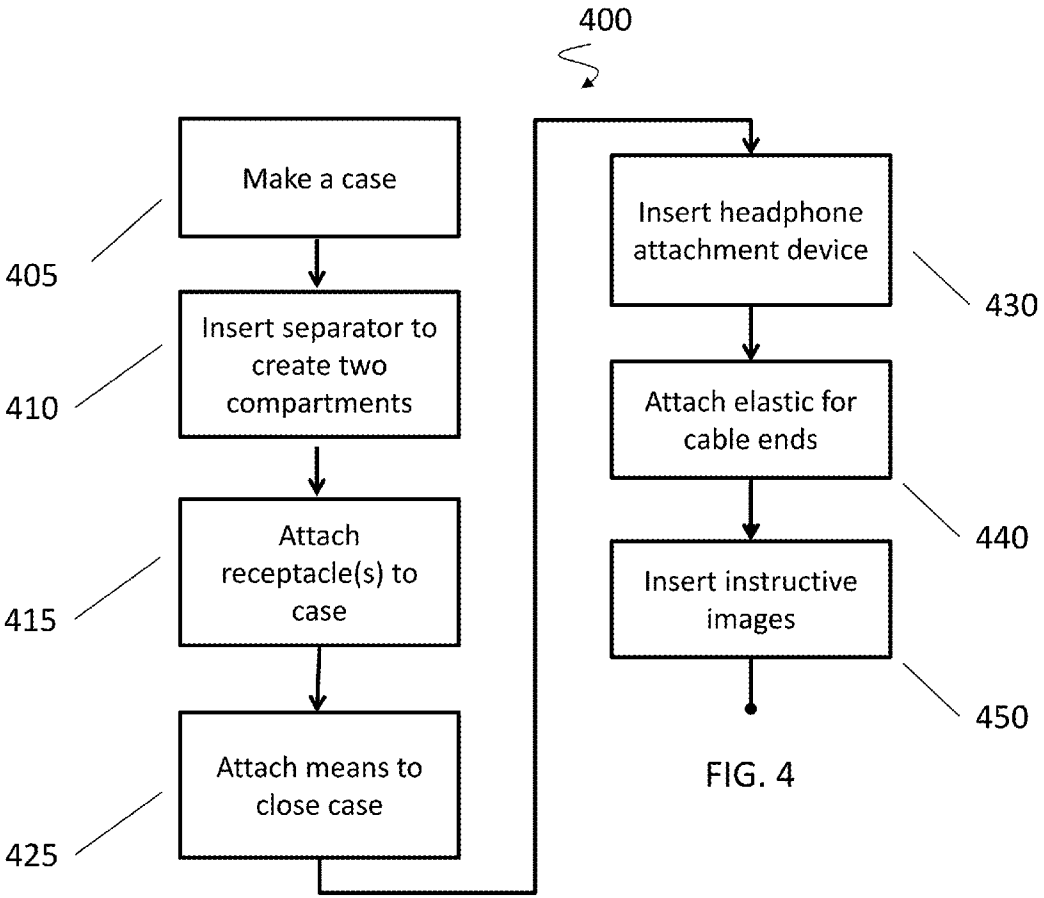
FIG. 4 shows an exemplary process for assembling a storage case.

FIG. 4 shows an exemplary process for assembling a storage case. A case can be made (405). The case can be a pouch, clamshell design, or other design used to store portable electronics or cables. A separator can be inserted into the case to make two compartments (410). For example, inserting a separator into the case to make two compartments (410) can include inserting a pouch within the case. Receptacles, such as a headphone jack, power outlet, MagSafe connector, or USB receptacle, can be inserted into the case (415). A means to close the case, such as a zipper, drawstring, or Velcro, can be attached to the case (425). A headphone attachment device, such as a speaker-portion securing device, can be inserted into the case (430). Elastic specifically designed to hold the ends of cables inside the case can be attached inside the case (440). Instructive images, such as pictures showing numbered steps and where to put portions of a corded device, can be inserted (450). The images can be attached or left unattached inside the case.

The steps described in FIG. 4 need not be performed in the order recited and two or more steps can be performed in parallel. In some implementations, other modifications can be made to the case, including asserting additional things.

Figure 5:
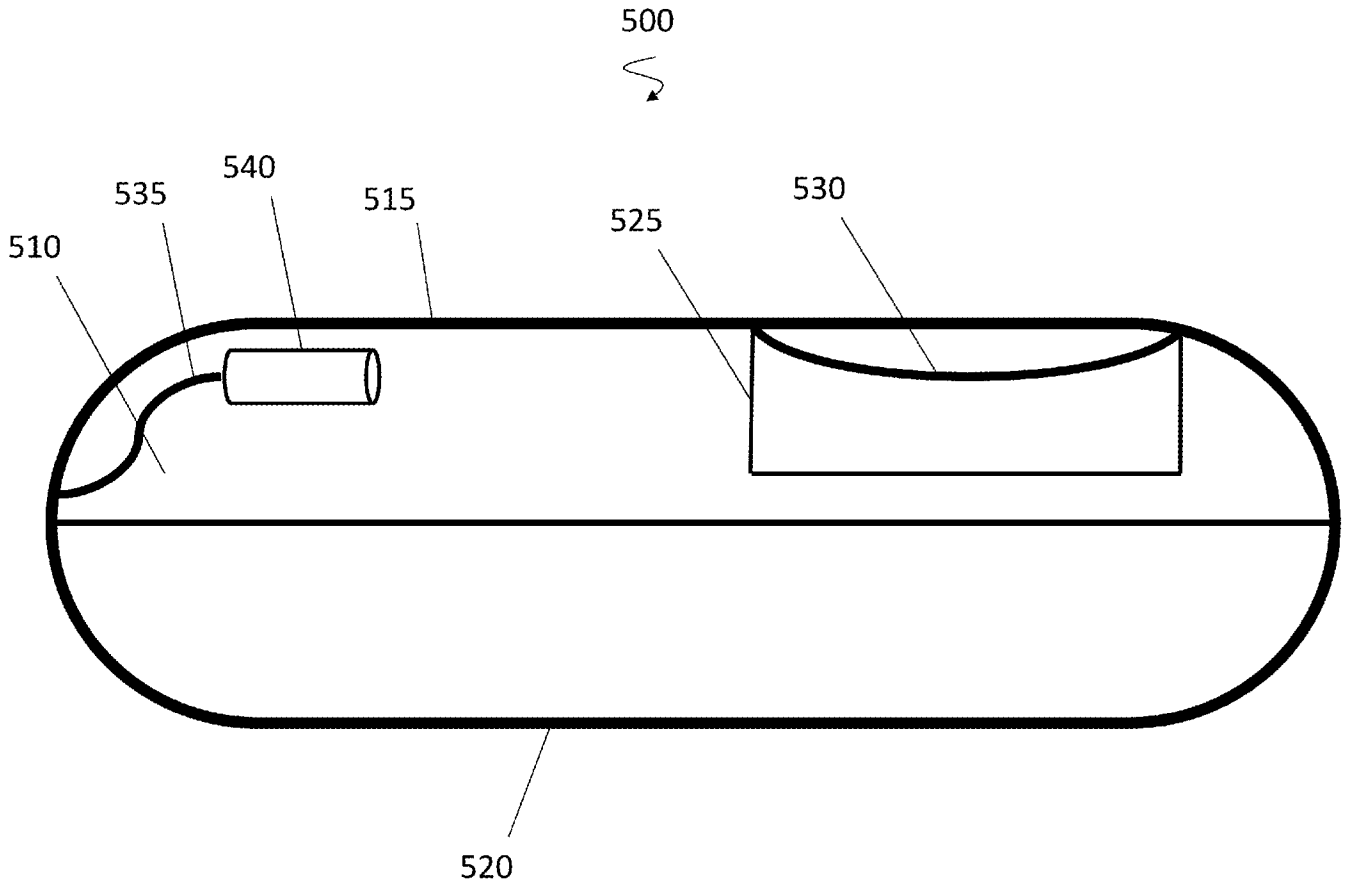
FIG. 5 shows an exemplary headphone storage case.

FIG. 5 shows an exemplary headphone storage case. Case 500 can include a pouch 510 comprised of the space between top piece 515 and bottom piece 520. Top piece 515 and bottom piece 520 can be fused along a portion of their length, while the remainder can include a zipper, Velcro, flap, magnet, or other closure device to enable a user to close the mouth of pouch 510. Alternatively, case 500 can be made of a single piece of material folded on one edge and joined together on two other edges, leaving an opening on the remaining edge. Case 500 can be made of any material used to store electronics, such as neoprene, textiles, plastics, rubber, etc. Case 500 can contain pouch 525 that separates case 500 into two compartments. Pouch 525 can be made from separate material or use a portion of case 500 as a side to pouch 525. Pouch 525 can include an opening 530 that is secured with elastic cord and stretch tight such that opening 535 is substantially closed when not displaced. Inside of pouch 525, a user can store the speaker portions of headphones. Inside of pouch 510 and substantially outside of pouch 525, a user can store the cable portion of the headphones. Case 500 can include cable 535 that attaches a headphone jack 540 to pouch 510. Headphone jack 540 can, alternatively, be directly connected to case 500. A user can insert the headphone plug into the headphone jack 540 to secure it and limit its movements. Similarly to the discussion above, jack 540, pouch 525 and pouch 510 can include writing or pictures indicating where to place portions of the headphone.

Figure 6:
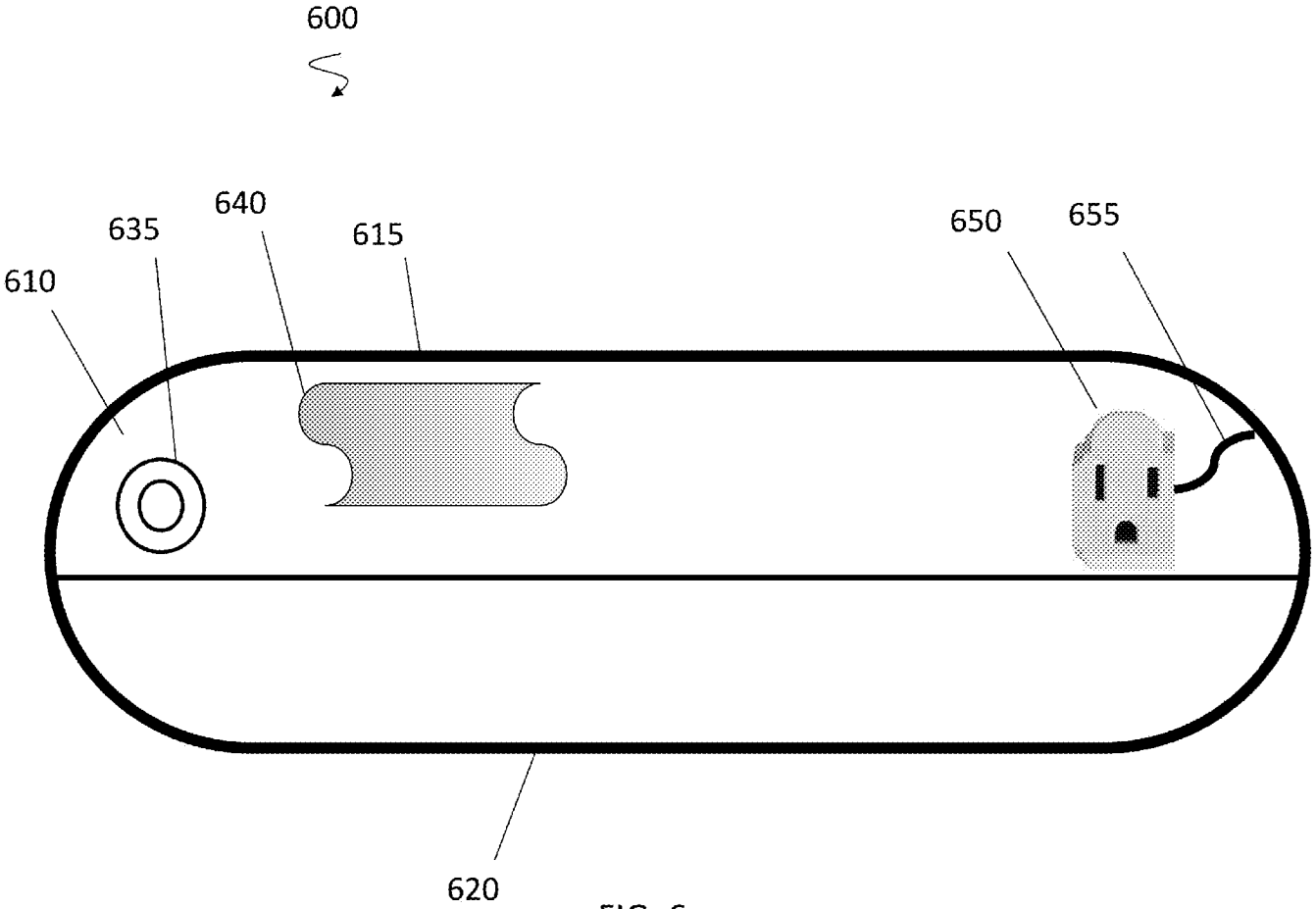
FIG. 6 shows another exemplary corded device storage case.

FIG. 6 shows an exemplary corded device storage case. Case 600 can include a pouch 610 comprised of the space between top piece 615 and bottom piece 620. Top piece 615 and bottom piece 620 can be fused along a portion of their length, while the remainder can include a zipper, Velcro, flap, magnet, or other closure device to enable a user to close the mouth of pouch 610. Alternatively, case 600 can be made of a single piece of material folded on one edge and joined together on two other edges, leaving an opening on the remaining edge. Case 600 can be made of any material used to store electronics, such as neoprene, textiles, plastics, rubber, etc. Pouch 610 can include a magnet 635. Magnet 635 can be used to secure one end of a corded device by placing the metallic end of a cord adjacent to magnet 635. Alternatively, elastic band 640 can be attached to the inside of pouch 610 and stretched tight. A user can slip an end of a cord under elastic band 640 to limit its movements inside the case. Electrical outlet 650 can be attached to pouch 610 by cable 655. Electrical outlet 650 can, alternatively, be directly connected to pouch 610. Case 600 can also include pictures or writing indicating where to put the MagSafe plug, electrical outlet plug, and/or cabling, as well as the recommended order.

In an alternative example, electrical outlet 650 can be replaced with an elastic strap sized to secure an electrical plug or power brick with the electrical prongs attached. In yet another alternative example, electrical outlet 650 can be replaced with a magnetized piece of metal with sufficient magnetic force to secure the electrical plug or power brick with electrical prongs attached.

In another example, the cases and techniques disclosed herein can be integrated into any bag or luggage, such as a suitcase, purse, a computer case, brief case, carry-on bag, backpack, or other luggage to substantially reduce the tangling of cables. Similarly, the case and techniques disclosed herein can be integrated into clothing, such as a jacket, vest, jeans, or any other piece of clothing that has pockets. For example, a headphone jack and/or a speaker-portion securing device could be integrated into the coin pocket of a pair of jeans or integrated into the coin pocket and the regular pocket of a pair of jeans.

A number of implementations have been disclosed herein. Nevertheless, it will be understood that various modifications can be made without departing from the spirit and scope of the claims. Accordingly, other implementations are within the scope of the following claim.

What is claimed is:

1. An apparatus consisting essentially of:

a case with an opening that allows access to an internal compartment;

a speaker-portion securing device fixed to the inside of the internal compartment operable to secure at least one earbud of a pair of headphones; and a headphone jack securing device fixed to the inside of the internal compartment and operable to secure a headphone plug of the pair of headphones;

wherein the headphone jack securing device is fixed to the inside of the internal compartment using a cable, wherein the internal compartment is operable to allow a cabled portion of the pair of headphones to remain free inside the internal compartment;

and wherein the headphone jack securing device comprises a female socket configured so that the headphone plug of the pair of the pair of headphones can be inserted in to the female socket to secure the headphone plug.

2. The apparatus of 1, wherein the speaker-portion securing device is a magnet.

3. The apparatus of 1, wherein the speaker-portion securing device comprises a separator that divides the inside of the case into two compartments, wherein the two compartments have openings adjacent to one another and aligned with the opening of the case.

4. The apparatus of 1, wherein the speaker-portion securing device comprises a pouch.

5. The apparatus of 1, wherein the case does not comprise a means to wind a headphone cable.

6. The apparatus of 1, further comprising a bag, wherein the case is integrated into the bag.

7. The apparatus of 1, further comprising clothing, wherein the case is integrated into the clothing.

8. An apparatus for storing a pair of headphones to reduce tangling without winding its cable, comprising:

a case for storing a pair of headphones;

a compartment formed inside of the case and comprising an opening for accessing a storage compartment;

wherein the compartment is operable to allow a cabled portion of the pair of headphones to remain free inside the internal compartment;

a pouch with an opening inside of the compartment operable to secure a speaker-portion of the pair of headphones;

a headphone jack securing device fixed to the inside of the compartment and operable to secure a headphone plug of the pair of headphones when inserted into the headphone jack securing device; and wherein the opening of the pouch comprises elastic.

9. The apparatus of 8, further comprising a means for closing the opening of the case.

10. The apparatus of 8, further comprising a bag, wherein the case is integrated into the bag.

11. An apparatus consisting essentially of:

a case with an opening that allows access to an internal compartment;

a speaker-portion securing device fixed to the inside of the internal compartment operable to secure at least one earbud of a pair of headphones; and a headphone jack securing device fixed to the inside of the internal compartment and operable to secure a headphone plug of the pair of headphones;

wherein the internal compartment is operable to allow a cabled portion of the pair of headphones to remain free inside the internal compartment; and wherein the headphone jack securing device comprises a female socket configured so that the headphone plug of the pair of headphones can be inserted in to the female socket to secure the headphone plug.

12. The apparatus of 11, wherein the speaker-portion securing device is a magnet.

13. The apparatus of 11, wherein the speaker-portion securing device comprises a separator that divides the inside of the case into two compartments, wherein the two compartments have openings adjacent to one another and aligned with the opening of the case.

14. The apparatus of 11, wherein the headphone jack securing device is fixed to the inside of the internal compartment using a cable.

15. The apparatus of 11, wherein the speaker-portion securing device comprises a pouch.

16. The apparatus of 11, wherein the case does not comprise a means to wind a headphone cable.

17. The apparatus of 11, further comprising a bag, wherein the case is integrated into the bag.

18. The apparatus of 11, further comprising clothing, wherein the case is integrated into the clothing.

* * * * *